United States Patent [19]

Villari, Jr. et al.

[11] 4,009,528

[45] Mar. 1, 1977

[54] SNEAKER WITH INSOLE

[76] Inventors: John J. Villari, Jr., 30 W. Central Ave., East Bangor, Pa. 18013; Charles Paraschos, P.O. Box 458, Portland, Pa. 18351

[22] Filed: Mar. 2, 1976

[21] Appl. No.: 663,067

[52] U.S. Cl. ..... 36/44; 36/29

[51] Int. Cl.[2] ..... A43B 13/38

[58] Field of Search ..... 36/136, 112, 29, 44

[56] References Cited

UNITED STATES PATENTS

| | | | |
|---|---|---|---|
| 3,418,732 | 12/1968 | Mozrshack | 36/44 |
| 3,629,961 | 12/1971 | Self | 36/44 X |
| 3,738,024 | 6/1973 | Matsuda | 36/136 |
| 3,914,881 | 10/1975 | Striegel | 36/44 |

*Primary Examiner*—Alfred R. Guest
*Attorney, Agent, or Firm*—John N. Randolph

[57] ABSTRACT

A sneaker or canvas shoe having an insole comprising a soft pad which is encased in a sealed film envelope to prevent the pad from absorbing moisture, odors and contamination. The envelope includes a chamber disposed beyond an end of the pad into which air can be forced, from the area of the envelope surrounding the pad, when pressure is applied to the insole by the weight of the wearer of the shoe. A part of the air chamber is heat sealed to the toe portion of the shoe, during the manufacture of the shoe, to retain the insole correctly positioned within the shoe.

6 Claims, 5 Drawing Figures

SNEAKER WITH INSOLE

SUMMARY

It is primary object of the present invention to provide an insole for a sneaker or canvas shoe which cannot absorb moisture and which will thus be free from odors and contamination.

More particularly, it is an object of the invention to provide an insole including a soft pad which is sealed within a thin film casing which includes an evacuated chamber into which air from the casing portion surrounding the pad can be forced when said casing portion and the pad are compressed by the weight of the wearer, so that the pressure within the casing will not rupture the seal provided thereby.

A further object of the invention is to provide a pad having a portion which is sealed to a part of the shoe during the manufacture thereof to retain the pad correctly positioned in the shoe.

Still a further object of the invention is to provide a sneaker or canvas shoe having an insole capable of resiliently supporting the foot of the wearer both by the resilience of the insole pad and the resistance of the compressed air within the insole casing, to provide an actual air cushioned shoe.

Another object of the invention is to provide an insole wherein the evacuated chamber includes an enlarged exposed portion which may be suitably ornamented to provide an animated display when said portion is alternately inflated and deflated by pressure being applied to and remove from, respectively, the envelope portion encasing the pad.

Various other objects and advantages of the invention will hereinafter become more fully apparent from the following description of the drawing illustrating a presently preferred embodiment thereof, and wherein:

DESCRIPTION OF THE PREFERRED EMBODIMENT

Figure 4:
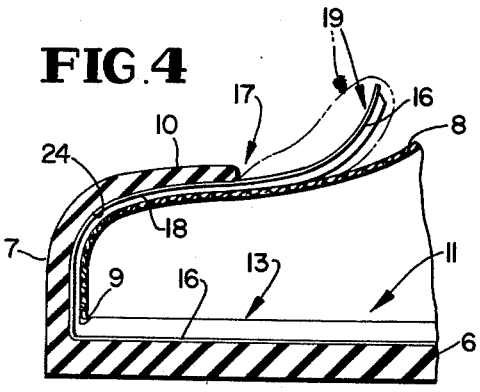
FIG. 4 is a longitudinal sectional view through the toe portion of the shoe.

Referring more specifically to the drawing, a sneaker or canvas shoe, designated generally 5, includes a sole 6, FIG. 4, of rubber, plastic or the like, and a welt 7 which is molded integral with the sole 6 and which surrounds the lower portion of a canvas upper 8. The sole 6 and welt 7 are bonded to the upper 8, as is conventional. As seen in FIG. 4, the front portion of the upper 8 is provided with a slot or recess 9. The front portion welt 7 is extended to provide a toe piece 10, as is conventional.

The shoe 5 also includes an insole 11 which is composed of a pad 12 of a non-cellular foam which is enclosed in a casing 13 consisting of a top layer 14 and a bottom layer 15. The layers 14 and 15 are formed of thin flexible plastic sheets or film, the side edge portions 16 of which are bonded together by heat sealing.

The pad 12 is snugly received in and occupies a large chamber of the casing 13, which additionally includes a restricted appendage 17 having a long narrow neck portion 18. The neck 18 projects from an end of the casing portion, enclosing the pad 12, and has a laterally enlarged outer portion 19 which may include outwardly tapered ends 20 and 21 and a convexly rounded outermost portion 22 which aligns with the neck 18. The heat seal 16 is continuous around the casing 13 except for the end 21 of the appendage 17 in which a vent port 23 is provided.

Figure 1:
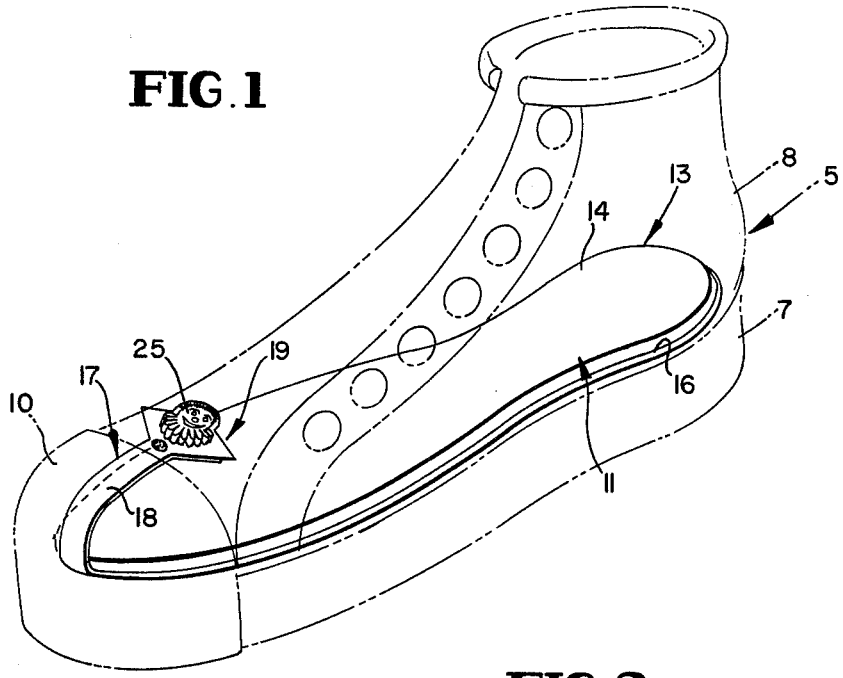
FIG. 1 is a perspective view of the insole shown applied to a sneaker or canvas shoe shown in broken lines.
Figure 5:
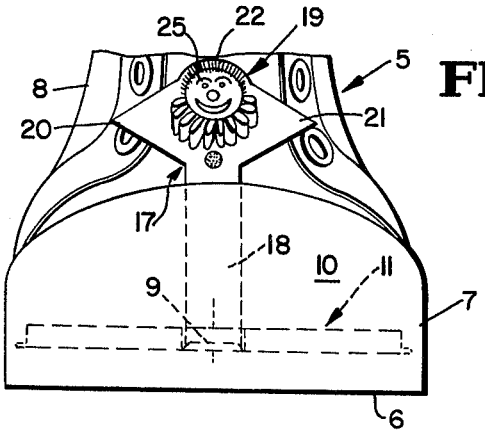
FIG. 5 is a fragmentary front elevational view of the shoe.

In manufacturing the shoe 5, the insole 13 is inserted into the upper 8 so as to rest on a bottom portion thereof which is surrounded by the welt 7 and rests on the sole 6. The appendage 17 including the neck 18 is drawn outwardly through the slot 9. The neck 18 is turned upwardly, beyond the slot 9, and engages in an internal recess 24 in the forward portion of the welt 7 and the toe piece 10. The neck 18 extends beyond the upper back edge of the toe piece 10 so that the enlarged portion 19 is located in an exposed position, as seen in FIG. 1, 4 and 5. The shoe is then injection molded in a conventional manner. Air is expelled from the appendage 17 and the exhaust port 23 is heat sealed after completion of the molding cycle to complete the assembly of the shoe 5 with the insole 11 anchored thereto.

From the foregoing, it will be readily apparent that the foot of the wearer of the shoe 5 is supported by the resilience of the pad 12 and by the resistance of the air within the casing 13, which is expelled from the casing portion surrounding the pad 12 into the appendage 17 from which the air was evacuated, each time that the weight of the wearer is applied to the insole 11. Since the pad 12 is completely sealed within the casing 13, it cannot absorb moisture and therefrom will not be contaminated or give off odors.

As seen in FIGS. 1 and 5, a front side of the enlargement 19 may be suitably ornamented, as seen at 25. Accordingly, each time that air is forced into the appendage 17, enlargement 19 will be inflated to animate the ornamentation 25. Further, it will be apparent that the size and shape of the enlargement 19 can be varied depending upon the manner in which it is to be ornamented. Also, the vent port 23 may be located in any desired part of said enlargement.

Figure 2:
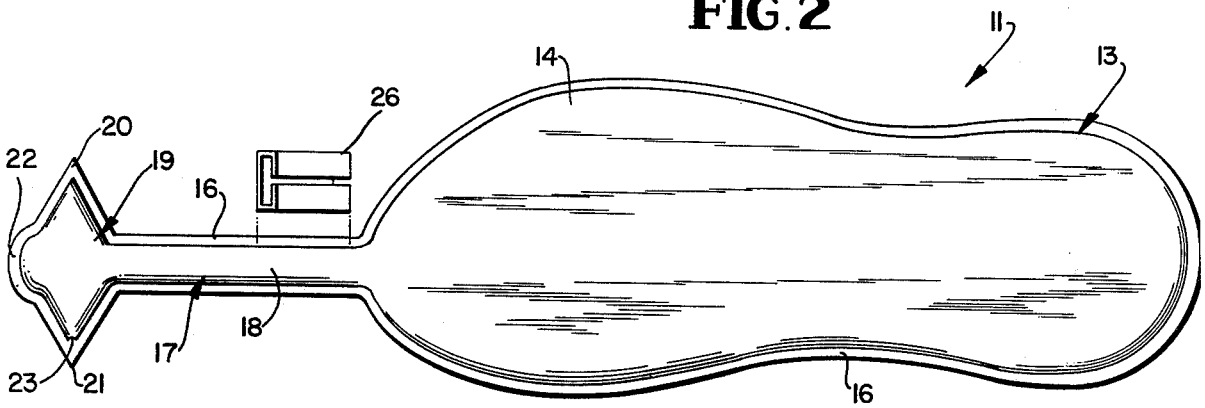
FIG. 2 is a top plan view of the insole.
Figure 3:
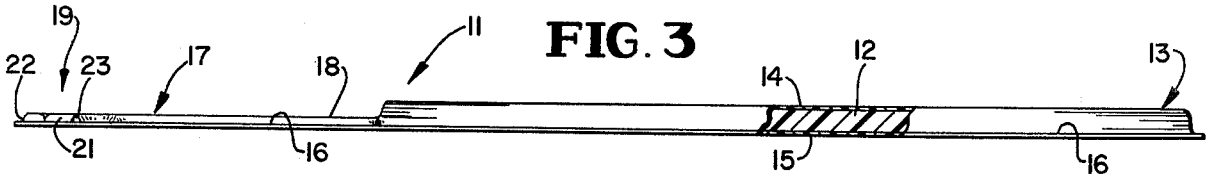
FIG. 3 is an edge elevational view, partly in longitudinal section thereof.

Any suitable spreader 26, as seen in FIG. 2, may be located in the portion of the neck 18 which extends through the slot 9 to positively prevent collapsing of this part of the neck if such collapsing and shutting off the air passage should occur.

Various modifications and changes are contemplated and may be resorted to, without departing from the function or scope of the invention.

We claim as our invention:

1. A sneaker or canvas shoe containing an insole including a foot sole-shaped pad and a casing enclosing said pad, said pad being formed of a resilient cushioning material capable of receiving and expelling air, two edge sealed sheets of thin elastic material constituting said casing and comprising a sealed air and moisture proof envelope having a main body portion of a shape and size to conformably enclose said pad and an appendage extending from the toe end of the main body portion to receive and entrap air expelled from the pad enclosing main body portion when pressure is applied to the insole for compressing the pad and collapsing the casing portion enclosing the pad.

2. A shoe as in claim 1 said appendage including a restricted neck and an enlarged outer portion disposed beyond said neck.

3. A shoe as in claim 2, said shoe having an internally recessed toe portion, a part of said neck being disposed in said toe portion for securing the insole in the shoe and for positioning said enlarged outer portion in an exposed position above the shoe.

4. A shoe as in claim 3, said enlarged outer portion having a front side containing ornamentation animated by inflation and deflation of the appendage.

5. A shoe as in claim 1 said pad being formed of noncellular foam.

6. A shoe as in claim 5, said appendage having a vent port through which air can be evacuated from the casing prior to heat sealing and closing of said port.

* * * * *